United States Patent [19]

Paulin

[11] Patent Number: 4,706,921

[45] Date of Patent: Nov. 17, 1987

[54] ANTENNA POST BASE SUPPORT AND METHOD OF INSTALLING SAME

[76] Inventor: Dale W. Paulin, 1242 Colonial Dr., Ashland, Ohio 44805

[21] Appl. No.: 819,717

[22] Filed: Jan. 17, 1986

[51] Int. Cl.[4] ..... A45F 3/44

[52] U.S. Cl. ..... 248/545; 248/530; 248/541; 248/156; 248/231.6; 52/158

[58] Field of Search ..... 248/545, 156, 528–533, 248/540–541, 88, 507, 508, 291, 512, 514, 515, 520; 52/155, 156, 159, 165, 158, 166; 403/385, 400

[56] References Cited

U.S. PATENT DOCUMENTS

| | | | |
|---|---|---|---|
| 293,225 | 2/1884 | Carson | 52/158 |
| 919,807 | 4/1909 | Bailey | 52/158 |
| 1,077,028 | 10/1913 | Bailey | 52/158 |
| 1,631,831 | 6/1927 | Jones | 403/385 |
| 2,826,281 | 3/1958 | Johnson | 52/158 |
| 3,148,851 | 9/1964 | Condon | 248/540 |
| 3,237,899 | 3/1966 | Lewis | 248/316.6 |
| 3,915,435 | 10/1975 | Carey | 52/158 |
| 4,166,601 | 9/1979 | Kato | 248/231.6 |
| 4,429,849 | 2/1984 | Maier | 52/155 |
| 4,560,135 | 12/1985 | Nestler | 248/558 |

FOREIGN PATENT DOCUMENTS

| | | | |
|---|---|---|---|
| 2202131 | 7/1973 | Fed. Rep. of Germany | 52/155 |
| 2430234 | 1/1975 | Fed. Rep. of Germany | 403/385 |
| 1354069 | 12/1964 | France | 52/155 |
| 411945 | 6/1934 | United Kingdom | 52/155 |

*Primary Examiner*—Reinaldo P. Machado
*Assistant Examiner*—Alvin Chin-Shue
*Attorney, Agent, or Firm*—Renner, Otto, Boisselle & Lyon

[57] ABSTRACT

The disclosure relates to a base support for an antenna mounting post and a method of installing the same in the ground. In one preferred embodiment the base support comprises two clamping members which may be positioned and secured about the outside diameter of a post after the post has been inserted into the ground to the appropriate depth. Each of the clamping members includes a pair of angularly adjustable guides each adapted to receive and support a rod that is driven into the ground to provide stabilizing support for the post. The angularly adjustable guides allow the rods to be driven into the ground at a variety of angles and, in the event an obstruction such as a rock is encountered while driving the rod, the rod may be withdrawn, the angle of the guide altered, and the rod reinserted into the guide and driven into the ground once again.

12 Claims, 6 Drawing Figures

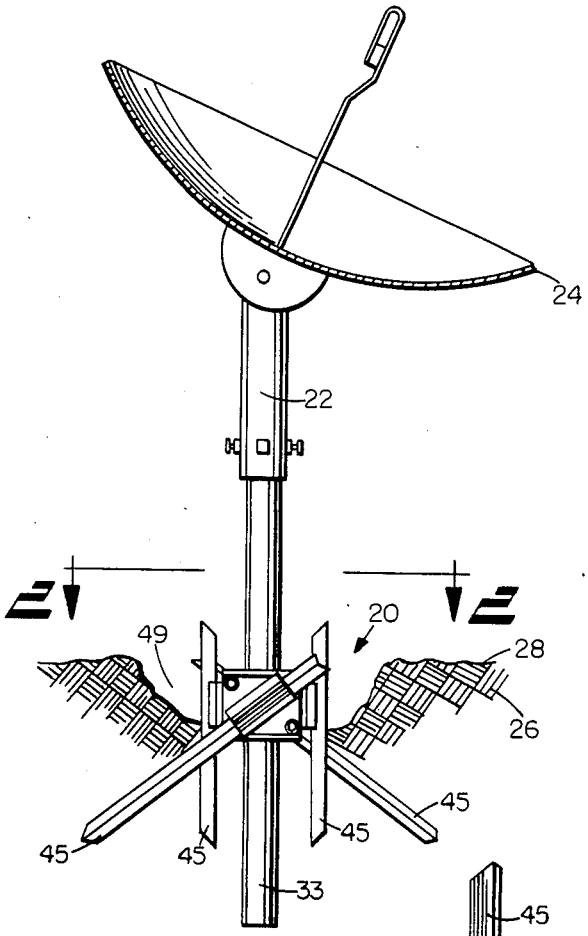
FIG. 1
FIG. 2
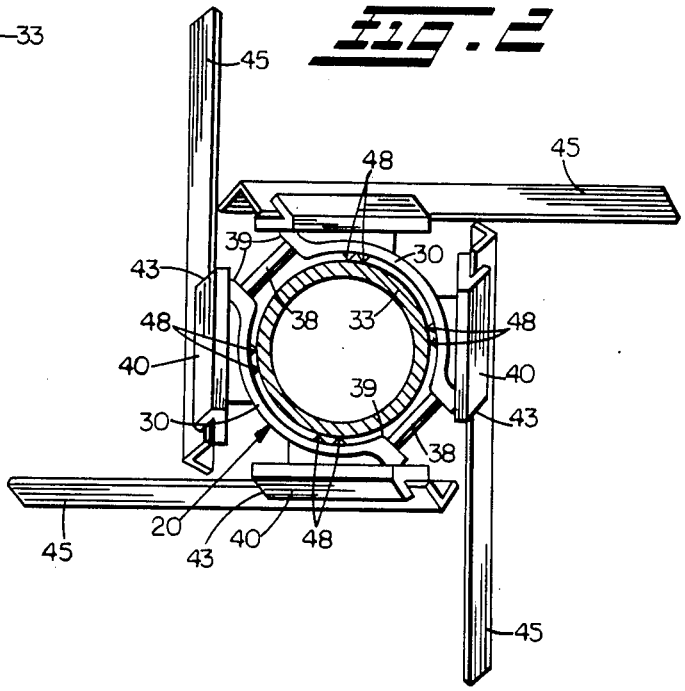

ANTENNA POST BASE SUPPORT AND METHOD OF INSTALLING SAME

TECHNICAL DISCLOSURE

The invention relates generally to a method and device for securely mounting an antenna post in the ground. More specifically, the invention relates to a base support for attachment to a post which provides a means for securely supporting the post in the ground.

BACKGROUND

Satellite dish antennas require an extremely stable mounting in order to remain accurately aimed. Even a movement of a few degrees may disrupt signal quality. Where the antenna is mounted on a single post, the post must be extremely stably anchored. Simply inserting the pole into the ground usually does not provide the requisite stability for the base of the pole to allow it to properly support the antenna. Therefore, in order to provide the necessary degree of stability to the base various alternative methods for supporting posts in the ground have been developed. Disadvantages are associated with each.

One common way to support a post in the ground is to dig an oversized hole in the ground, insert the pole in the hole, and pour concrete into the hole about the base of the post. This method results in a secure foundation for the pole, but it requires considerable time, equipment, materials and appropriate weather conditions. When applied to a satellite dish antenna pole this job is a two-day operation. On the first day the pole is set in concrete. The antenna itself cannot be mounted and aimed until the next day so that the concrete can set. Finally, the dirt excavated from the hole must be disposed. Thus, this method of installation can result in considerable cost. Additionally, post installations of this type are generally permanent in nature, there is little possibility of relocating the post subsequent to installation.

One method of mounting a fence post into the ground without concrete comprises utilizing a collar assembly which may be affixed to the base of the pole once the pole has been inserted into the ground. The collar assembly includes two fixed guides each of which receives a rod which is driven into the ground to stabilize the base of the post. Unfortunately, if an obstruction is encountered, for example a rock, while driving one of the rods into the ground, either the rod or rods must be withdrawn and the collar rotated about the post, or the entire installation must be abandoned and the hole and post relocated.

Other methods of mounting an antenna post in the ground are also available and these methods are disclosed and summarized in the information disclosure statement filed with this application. Unfortunately, although many of these methods provide a means for securely supporting such a post in the ground, they provide either the same disadvantages as previously discussed or others.

SUMMARY OF THE INVENTION

The present invention comprises a base support which provides an inexpensive and convenient means and method of securing a generally vertical dish antenna mounting post in the ground. To use the invention a hole is bored in the ground only slightly larger than the diameter of the post. The hole is enlarged near grade to permit installation of the base support just below grade. The post is placed in the hole and fill is tamped around it. Then the base support is fastened to the post and stakes or rods are driven into the ground. With the post thus securely positioned, the hole around the base is backfilled, and the dish antenna mounted and aimed, all within a few hours at most.

In a preferred embodiment the base support comprises a pair of semicircular clamp members which may be securely clamped or fastened to the outside surface of a post just below ground level. Each of the clamp members includes a pair of angularly adjustable guides having channels adapted to receive and support a stake or rod upon insertion of the stake or rod into the channel.

The guides are connected to their respective clamp members by a bolt which extends through the guide and threads into the clamp member. The clamp members each have a protruding rib near the mounting locations for the guides and one of the major surfaces of each of the guides includes a plurality of radially extending grooves each of which may receive and interlock with the protruding rib on the clamp. When the guide has been adjusted to the desired angle relative to the post and the bolt tightened, the protruding rib securely engages a selected one of the grooves on the guide, and the guide is securely fastened in the selected angular position.

When the guides have been tightened, the stakes or rods are inserted in the guide channels and driven into the ground. The post is then securely supported in the ground. In the event the stakes or rods should encounter an obstacle such as a rock which prevents the stake or rod from being driven its full extent into the ground, the stake or rod may be withdrawn, the stake or rod angularly repositioned, and the stake or rod redriven avoiding the obstacle.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 1 is a side elevation assembly view of a preferred embodiment of the invention as it would appear supporting a satellite antenna dish and post in the ground;

FIG. 2 is a view in the direction of arrows 2—2 of FIG. 1 illustrating two clamp members, four guides secured to the clamp members and a stake or rod through each guide;

DETAILED DESCRIPTION OF PREFERRED EMBODIMENT

Figure 4:
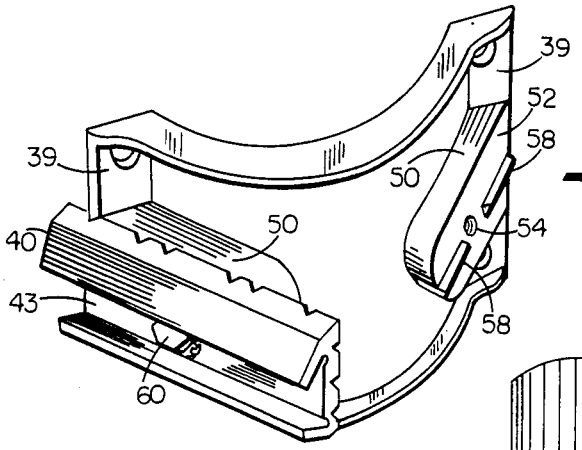
FIG. 4 is a perspective view of one of the clamp members of the base support of FIG. 1 and a guide mounted to it.

FIGS. 1 and 2 illustrate a base support 20 made in accordance with the present invention supporting a generally vertical post 22 of a satellite antenna dish 24 in the ground 26. As illustrated the post is generally vertical and the top surface of the ground 26 defines a generally horizontal grade 28. Of course the present invention can be utilized where the grade 28 is not horizontal.

Figure 3:
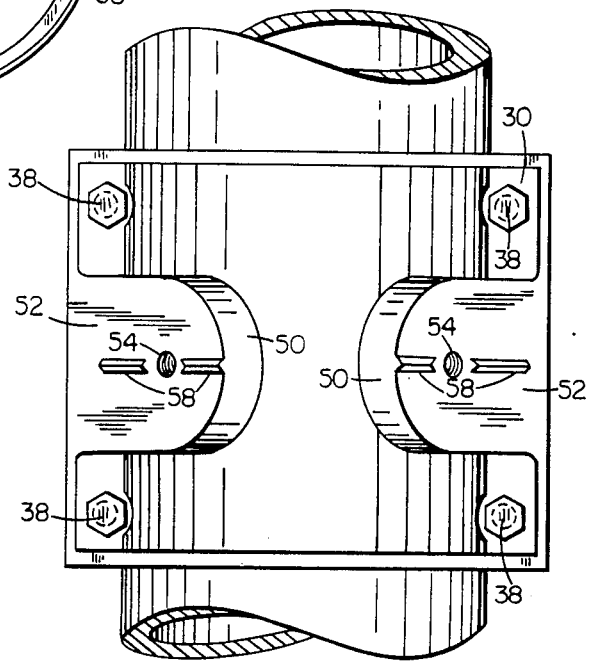
FIG. 3 is a side elevational view of a clamp member shown in FIG. 1 clamped to a post.

The base support 20 comprises a pair of clamping members 30 (FIG. 2) which are secured about the base 33 of the post 22. Four interconnecting bolt and nut assemblies 38 which extend from diametrically opposite flanges 39 located at the ends of the clamping members are provided for this purpose. The clamp members 30 each have semicircular inside surfaces 46 which include protruding ribs 48 to ensure a firm grip between the clamp members 30 and the outside surface of the post 22 once the nut and bolt assemblies 38 are tightened (see FIG. 3).

Each of the clamping members 30 (FIG. 2) includes a pair of angularly adjustable guides 40. Each guide 40 includes a guide channel 43 shaped to slidably receive and support a stake or rod 45. When the guides 40 have been adjusted to the desired angular location and the clamp members 30 locked to the post 22, stakes 45 are driven through the guide channels 43 into the ground to securely locate the post 22.

The base support 20 and post 22 are installed in accordance with the principles of the present invention by first digging a hole in the ground having a diameter slightly greater than the diameter of the post to the appropriate depth. For many applications the appropriate depth may be, for example, approximately one-third the length of the post. A conventional auger may be used for this purpose. A small additional excavation is made to enlarge the top of the hole as shown at 49 so that the base support 20 will be below grade 28. This not only makes a more attractive finished appearance but also eliminates sharp edges which might otherwise protrude in a dangerous fashion. The post is then placed into the hole and the hole is backfilled around the outside of the post 22 up to the level of the bottom of the enlarged portion 49 of the excavation.

The clamping members 30 are then mounted and secured to the base just below grade. Once the clamping members 30 are secured to the post base 22, the angularly adjustable guides 40 are aimed at the ground and securely fastened into position. Each clamping member 30 includes a pair of bosses 50 which extend from each of its ends. The bosses 50 (FIG. 3) define planes 52 which are parallel to the axis of the post 22 and at 90° to each other. The bosses 50 serve as reinforced mounting platforms for the guides 40.

The guide 40 (FIG. 4) is attached to the boss utilizing a bolt 60. To this end each of the bosses 50 includes a threaded hole 54 to receive bolt 60. Loosening of the bolt 60 allows the guide 40 to rotate relative to the axis of the post, and conversely tightening of the bolt 60 draws the guide 40 into tight engagement with the surface 52 of a clamping member.

Figure 6:
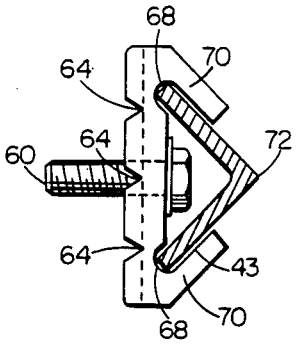
FIG. 6 is a view looking in the direction of arrows 6—6 of FIG. 5.
Figure 5:
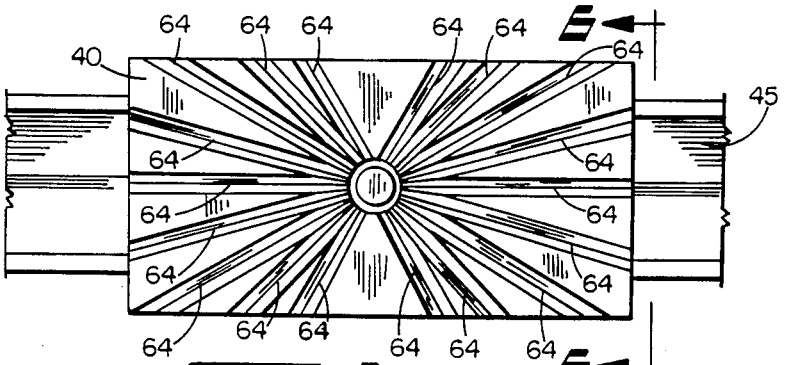
FIG. 5 is a side elevation of a major surface of the guide of FIG. 1 illustrating radially extending grooves.

Means are provided to securely lock the guide 40 in any one of a number of angular positions with respect to the associated clamp member 30. For this purpose the surface 52 of the boss 50 is provided with a pair of ribs 58 which extend radially from hole 54. Each guide 40 (FIGS. 5 and 6) includes a plurality of corresponding radially arranged grooves 64. Once the guide 40 has been rotated to a position in which the ribs 58 are aligned with a selected one of the grooves 64, the bolt 60 is tightened to lock the guide 40 in the selected position.

The guide channel 43 is shaped to slidably receive the stake 45. As shown in this particular preferred embodiment the stake 45 is a conventional piece of angle iron whose legs intersect forming a 90° angle. To accommodate the angle iron stake 45 the guide channel is formed with a pair of rounded troughs 68 which receive the edges of the stake 45 and a pair of arms 70 which slide along the legs of the stake 45. The arms 70 do not connect at the apex 72 of the stake 45 to permit access to the bolt 60. Although other shapes of stakes 45 and guide channels 43 are possible, the use of an angle as shown is particularly advantageous since the legs of the angle span the head of bolt 60, and so no countersinking of the bolt 60 is required to permit the stake 45 to slide.

Installation of the base is made complete by inserting a piece of angle iron 45 into each of the guide channels 43 and hammering them into the ground until the end of the angle 45 is located in the proximity of the guide 40. In the event an obstruction such as a stone is encountered while driving one of the angles, the angle may be removed from the guide, the guide repositioned and the angle reinserted and redriven once again into the ground. If necessary, a single guide may be repositioned several times if the ground is found to contain numerous obstructions.

Once the angles have been driven the enlarged excavation 49 at the top of the hole may be refilled with dirt to grade level creating an aesthetically pleasing appearance.

Although in the preferred embodiment four guides equally spaced along the outside surface of the clamping members have been shown, it will be appreciated that any number of guides may be used and their spacing along the clamping members altered depending upon the type of soil and the load intended to be supported by the post. Although in the preferred embodiment conventional angle iron and guides having channels adapted to receive and support such angles have been illustrated, a rod and guide having any one of a variety of configurations may be used for example round, rectangular, square, or any variation thereof. The stakes 45 are described as being angle iron, but any suitably stiff and tough material, either metal or plastic, may be used.

Additionally, it will be appreciated that although in the preferred embodiment the bosses 50 are shown to have a protruding rib, the operation of the guides would in no way be hampered if the guides were instead provided with a protruding rib and the bosses with a plurality of grooves. Furthermore, it will be appreciated that instead of having a pair of clamping members, a base support made in accordance with the present invention may merely comprise a single piece clamp member or collar. Alternatively, three or more clamp members may be provided.

Thus it is clear that the present invention comprises a base support which provides an inexpensive and convenient means and method of securing a dish antenna mounting post in the ground.

In a preferred embodiment the base support 20 comprises a pair of semicircular clamp members 30 which may be securely clamped or fastened to the outside surface of a post 22 just below ground level 28 after the post has been inserted into the ground. Each of the clamp members 30 includes a pair of angularly adjustable guides 40 having channels 43 adapted to receive and support a stake or rod 45 upon insertion of the stake or rod into the channel.

The guides 40 are connected to the clamp members 30 by a bolt 60 which extends through the guide and threads into the clamp member. The clamp members have a protruding rib 58 near the mounting location for the guides 40, and one of the major surfaces of each of the guides includes a plurality of radially extending grooves 64 each adapted to receive and interlock with the protruding rib on the clamp. When the guide 40 has been adjusted to the desired angle relative to the post 22 and the bolt 60 tightened, the protruding rib 58 securely engages a groove 64 on the guide, and the guide is securely fastened in position.

Once the guides 40 have been tightened into position the stakes or rods 45 are inserted in the channels 43 and driven into the ground resulting in the post 22 being securely supported in the ground. In the event the stake or rod 45 should encounter an obstacle such as a rock which prevents the stake or rod from being driven its full extent into the ground, the stake or rod may be withdrawn and the guide 40 repositioned and the stake or rod redriven avoiding the obstacle. Additionally, in the event it becomes necessary to relocate the post subsequent to installation, one may simply withidraw the stakes or rods, remove the post from the ground and relocate the post and support to a new hole.

The following is claimed:

1. A base support for supporting a generally vertical antenna post in ground containing randomly located obstructions such as rocks, said base support comprising a pair of clamp members adapted for assembly with each other to encircle said post, means for drawing said clamp members into tight engagement with said post, a plurality of rods to be driven into the ground at angles transverse to said post, guide means secured to said clamp members and associated with each of said rods for slidably receiving an associated one of said rods as said rod is driven into the ground, and adjustment means for repositioning said guide means with respect to said clamp members upon encountering an obstruction in the ground with one of said rods, said adjustment means including means for adjusting the angle of said one of said guide means associated with said rod with respect to said post, and a bolt associated with each of said guide means for securing the respective guide means and clamp members to each other, said guide means having an opening providing access to said bolt upon removal of the rod associated with the guide means, said rod blocking access to said bolt through said opening upon receipt of said rod in the associated guide means.

2. A base support as set forth in claim 1 wherein said rod comprises a conventional angle.

3. A base support as set forth in claim 1 wherein each of said clamp members is semi-circular in shape.

4. A base support as set forth in claim 3 wherein said clamp members include a protruding rib to ensure a firm grip between said clamp members and the outside surface of said post.

5. A base support as set forth in claim 1 wherein said guide means comprises a guide having a channel adapted to receive said rod.

6. A base support as set forth in claim 5 wherein said means for adjusting the angle of said guide means comprises a plurality of radially arranged protruding ribs on one of said clamp members and said guide, and a groove on the other of said clamp members and said guide adapted to receive and interlock with at least one of said protruding ribs.

7. A base support as set forth in claim 5 wherein said means for adjusting the angle of said guide means comprises a protruding rib on one of said clamp members and said guide, and a plurality of radially arranged grooves on the other of said clamp members and said guide each adapted to receive and interlock with said protruding rib.

8. A base support as set forth in claim 7 wherein said means for drawing said clamp members into tight engagement with said post comprises a bolt and nut assembly interconnecting said clamp members.

9. A base support as set forth in claim 7 wherein said bolt when loosened allows said guide to angularly adjust.

10. A method of securing an antenna post into the ground comprising the steps of digging a hole in said ground large enough to allow said post to be inserted into said ground, inserting said post into said hole, clamping to the outside surface of said post in the proximity of the opening of said hole a base support comprising a pair of clamp members and having a plurality of angularly adjustable guides each adapted to receive and support a rod, and having a bolt associated with each of the guides for securing the respective guides and clamp members to each other, each guide having an opening providing access to said bolt upon removal of the rod associated with the guide, said rod blocking access to said bolt through said opening upon receipt of said rod in the associated guide, angularly adjusting and securing each of said guides such that said guides are aimed into the ground, inserting a rod into each of said guides, driving each of said rods into the ground until the end of each of said rods is in the proximity of its respective guide, said step of driving each of said rods including the step of hitting an obstruction while driving one of said rods which prevents said rod from being driven into said ground, withdrawing said obstructed rod from said guide, repositioning and securing said guide to an alternate angle with respect to said post, reinserting said rod into said repositioned guide, and driving said rod into said ground until the end of said rod is in the proximity of said repositioned guide.

11. The method of claim 10 wherein the step of angularly adjusting and securing each of the guides includes the step of accessing a bolt through an opening in each guide to tighten the bolt.

12. The method of claim 11 wherein the step of inserting the rod into a guide includes the step of blocking the bolt access opening in the guide.

* * * * *

UNITED STATES PATENT AND TRADEMARK OFFICE

CERTIFICATE OF CORRECTION

PATENT NO. : 4,706,921

DATED : November 17, 1987

INVENTOR(S) : Dale W. Paullin

It is certified that error appears in the above-identified patent and that said Letters Patent is hereby corrected as shown below:

On the Title Page, Items [19] and [76] "Paulin" should read

--Paullin--

Signed and Sealed this

Thirty-first Day of May, 1988

*Attest:*

*Attesting Officer*

DONALD J. QUIGG

*Commissioner of Patents and Trademarks*